US010728665B2

(12) United States Patent
Takumai

(10) Patent No.: US 10,728,665 B2
(45) Date of Patent: Jul. 28, 2020

(54) AUDIO DEVICE, AUDIO SYSTEM, AND CHANNEL DISTRIBUTION METHOD

(71) Applicant: Yamaha Corporation, Hamamatsu-shi, Shizuoka-Ken (JP)

(72) Inventor: Susumu Takumai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/908,517

(22) Filed: Feb. 28, 2018

(65) Prior Publication Data

US 2018/0279046 A1 Sep. 27, 2018

Related U.S. Application Data

(63) Continuation of application No. PCT/JP2017/011699, filed on Mar. 23, 2017.

(51) Int. Cl.

| | |
|---|---|
| ***H04R 3/12*** | (2006.01) |
| ***H04S 3/00*** | (2006.01) |
| ***H04S 7/00*** | (2006.01) |

(52) U.S. Cl.

CPC ..... *H04R 3/12* (2013.01); *H04S 3/008* (2013.01); *H04S 7/00* (2013.01); *H04R 2420/07* (2013.01)

(58) Field of Classification Search

None

See application file for complete search history.

(56) References Cited

U.S. PATENT DOCUMENTS

| | | | | |
|---|---|---|---|---|
| 2004/0107271 | A1* | 6/2004 | Ahn | H04M 1/6066 709/219 |
| 2012/0087503 | A1* | 4/2012 | Watson | H04S 3/008 381/23 |
| 2015/0018994 | A1* | 1/2015 | Millington | H04J 3/0664 700/94 |
| 2015/0104037 | A1* | 4/2015 | Lee | H04R 27/00 381/80 |

(Continued)

FOREIGN PATENT DOCUMENTS

| | | | |
|---|---|---|---|
| JP | 2005-341618 | A | 12/2005 |
| JP | 2016-178396 | A | 10/2016 |
| JP | 2017-5297 | A | 1/2017 |

(Continued)

OTHER PUBLICATIONS

Roberts, C.M.: Radio frequency identification (RFID). Computers and Security 25(1), 18-26 (2006) (Year: 2006).*

(Continued)

*Primary Examiner* — Kenny H Truong

(74) *Attorney, Agent, or Firm* — Crowell & Moring LLP

(57) ABSTRACT

An audio device comprising: at least one processing circuit configured to implement stored instructions and execute a plurality of tasks, wherein the plurality of tasks include: a reading task that, from a medium that stores channel information, reads the channel information; an obtaining task that obtains individual identification information of an own device; a transmitting task that transmits the channel information read from the medium and the individual identification information to a content output device that outputs content including a plurality of channels; and a receiving task that receives at least one channel in the content.

19 Claims, 10 Drawing Sheets

(56) References Cited

U.S. PATENT DOCUMENTS

| | | | | |
|---|---|---|---|---|
| 2017/0142536 | A1 | 5/2017 | Hattori et al. | |
| 2018/0226931 | A1* | 8/2018 | Kim | H03G 3/3005 |

FOREIGN PATENT DOCUMENTS

| | | | |
|---|---|---|---|
| WO | WO 2008/126161 | A1 | 10/2008 |
| WO | WO 2015/087729 | A1 | 6/2015 |
| WO | WO 2015/194326 | A1 | 12/2015 |

OTHER PUBLICATIONS

International Search Report (PCT/ISA/210) issued in PCT Application No. PCT/JP2017/011699 dated May 16, 2017 (Japanese-language)(Three (3) pages).

English translation of document C1 (Japanese-language International Search Report (PCT/ISA/210) previously filed on Feb. 28, 2018) issued in PCT Application No. PCT/JP2017/011699 dated May 16, 2017 (two (2) pages).

Japanese-language Office Action issued in Japanese Application No. 2019-506826 dated May 26, 2020 with English translation (six (6) pages).

* cited by examiner

Fig. 4

| AUDIO DEVICE | IP ADDRESS | MAC ADDRESS | IC TAG | CHANNEL |
|---|---|---|---|---|
| SPEAKER11 | 192.168.0.11 | A1:B1:D1:1F:11:B1 | C | C |
| SPEAKER12 | 192.168.0.12 | A1:B1:D1:1F:11:B2 | FR | FR |
| SPEAKER13 | 192.168.0.13 | A1:B1:D1:1F:11:B3 | SR | SR |
| SPEAKER14 | 192.168.0.14 | A1:B1:D1:1F:11:B4 | SL | SL |
| SPEAKER15 | 192.168.0.15 | A1:B1:D1:1F:11:B5 | FL | FL |

AUDIO DEVICE, AUDIO SYSTEM, AND CHANNEL DISTRIBUTION METHOD

CROSS REFERENCE TO RELATED APPLICATIONS

The present application is a continuation of International Application No. PCT/JP2017/11699, filed on Mar. 23, 2017, the entire contents of which is incorporated herein by reference.

BACKGROUND OF THE INVENTION

1. Field of the Invention

A preferred embodiment of the present invention relates to an audio device, an audio system, and a channel distribution method that easily set a channel of content.

2. Description of the Related Art

In an audio system such as a multichannel audio system, a plurality of speakers are installed. When content distribution is performed, the assignment of channels included in content to each speaker is required. In such an assignment of a channel, in order to reduce a mistake of a user, International Publication No. 2008/126161 discloses a channel assigning device that automatically assigns a channel to a plurality of speakers that have been connected.

In the channel assigning device of International Publication No. 2008/126161, a microphone is provided in order to pick up measurement sound output from a plurality of speakers. Although an amplifier device performs an automatic sound field correction process from the sound that the microphone has picked up, since measurement takes time and it is necessary to perform a plurality of times of measurement to identify a position of each of the plurality of speakers, measurement is very complicated.

SUMMARY OF THE INVENTION

In view of the foregoing, an object of the present invention is to provide an audio device, an audio system, and a channel distribution method that are able to more easily perform assignment of a channel.

An audio device according to a preferred embodiment of the present invention is provided with at least one processing circuit configured to implement stored instructions and execute a plurality of tasks, and the plurality of tasks include: a reading task that, from a medium that stores channel information, reads the channel information; an obtaining task that obtains individual identification information of an own device; a transmitting task that transmits the channel information read from the medium and the individual identification information to a content output device that outputs content including a plurality of channels; and a receiving task that receives at least one channel in the content.

According to the present invention, a user can easily assign a channel to an audio device even in a multichannel audio system.

The above and other elements, features, characteristics, and advantages of the present invention will become more apparent from the following detailed description of the preferred embodiments with reference to the attached drawings.

BRIEF DESCRIPTION OF THE DRAWINGS

FIG. 4 is a table illustrating an example of channel information of an IC (Integrated circuit) tag attached to an audio device and a channel of content to be assigned to the audio device.

DETAILED DESCRIPTION OF THE PREFERRED EMBODIMENTS

Figure 1:
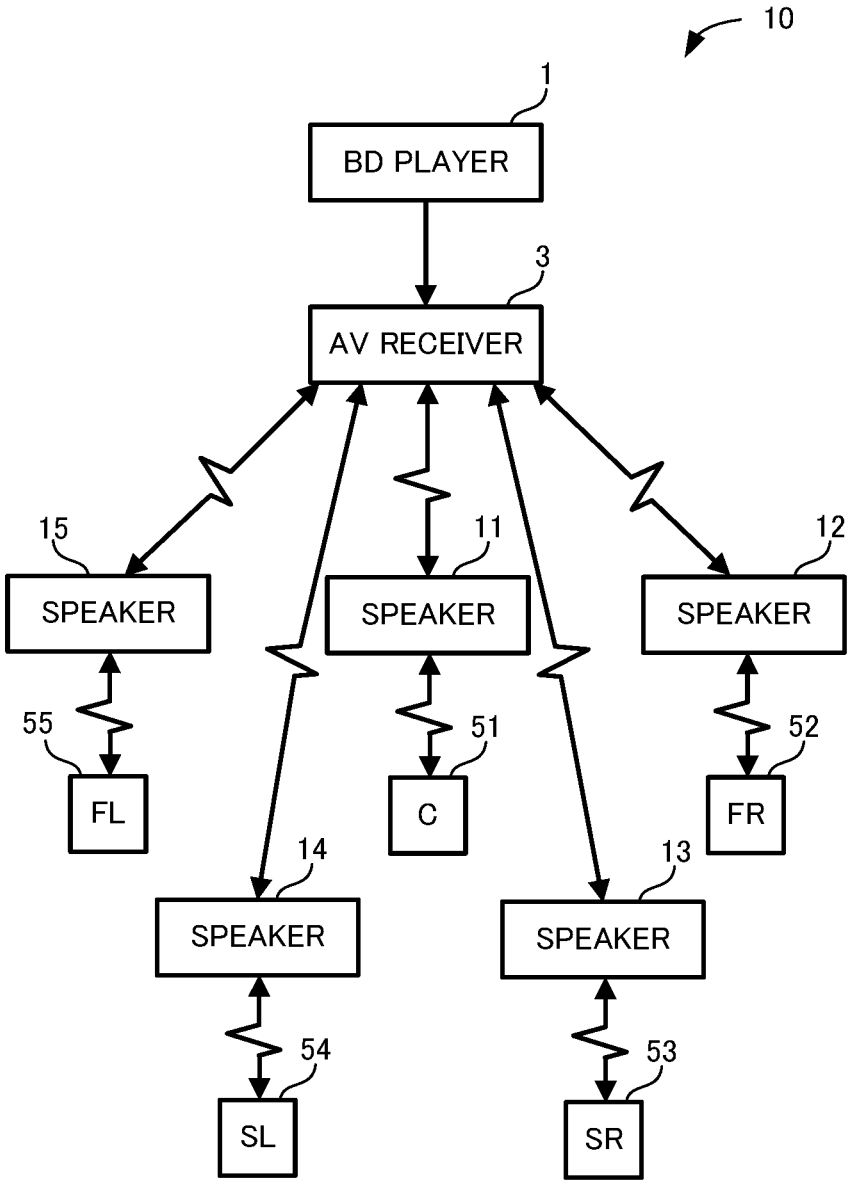
FIG. 1 is a conceptual diagram illustrating a configuration of an audio system according to a preferred embodiment.
Figure 2:
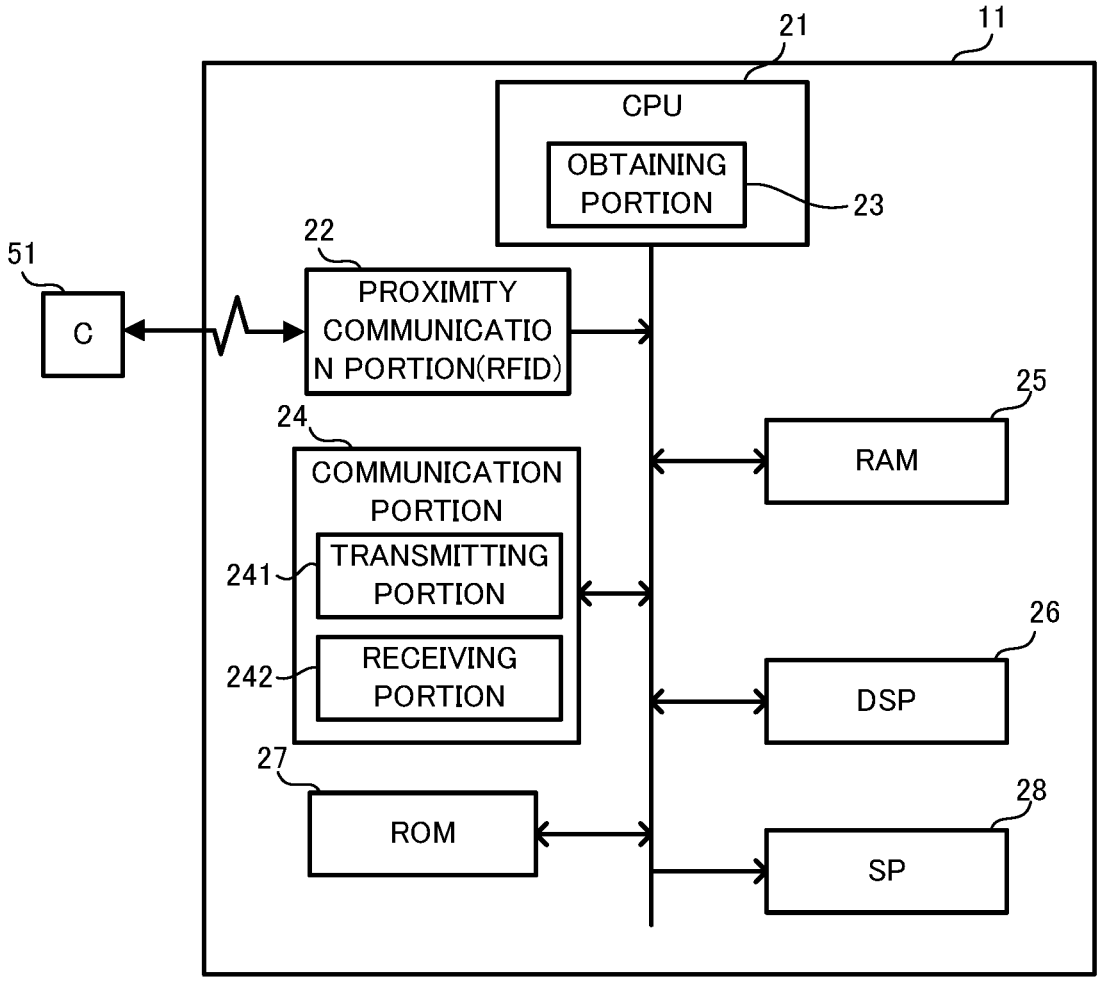
FIG. 2 is a block diagram illustrating a configuration of an audio device according to a preferred embodiment.
Figure 3:
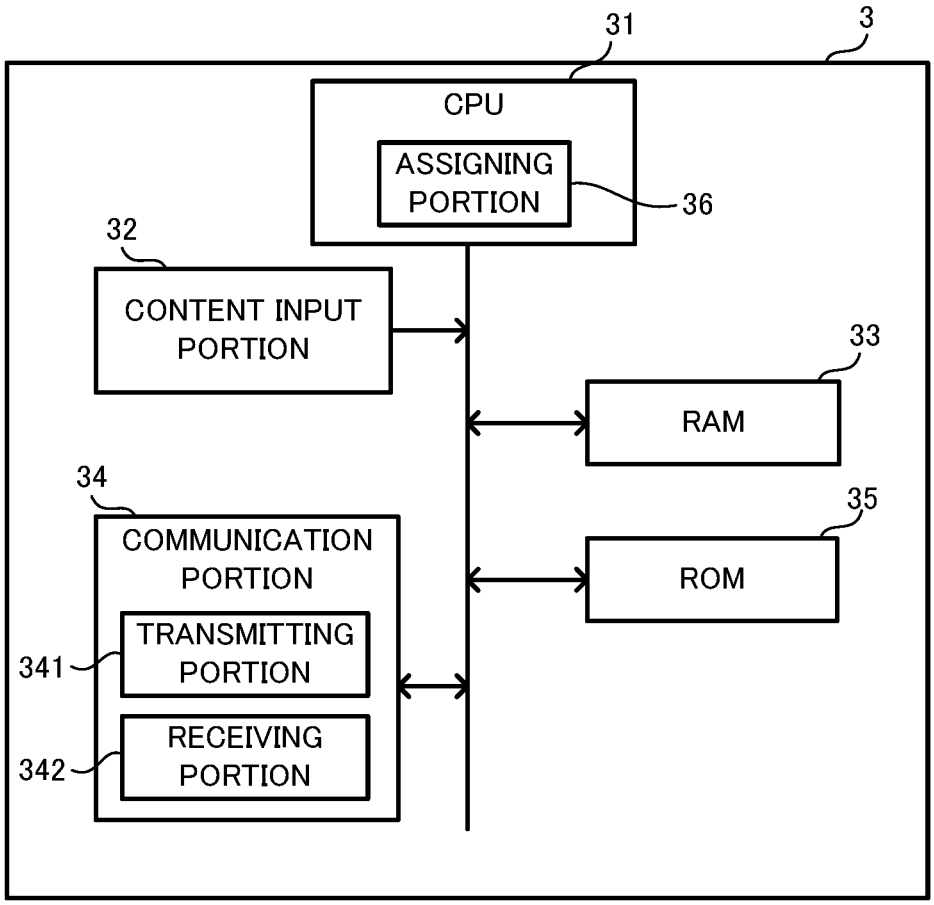
FIG. 3 is a block diagram illustrating a configuration of an AV receiver according to a preferred embodiment.

FIG. 1 is a conceptual diagram illustrating a configuration of an audio system 10 according to a preferred embodiment. FIG. 2 is a block diagram illustrating a configuration of a wireless speaker 11 according to a preferred embodiment. FIG. 3 is a block diagram illustrating a configuration of an AV receiver 3 according to a preferred embodiment.

As illustrated in FIG. 1, the audio system 10 is provided with a BD (Blu-ray Disc) player 1, an AV receiver 3, and a plurality of audio devices (a wireless speaker 11, a wireless speaker 12, a wireless speaker 13, a wireless speaker 14, and a wireless speaker 15). The BD player 1 reproduces content. The BD player 1 transmits the reproduced content to the AV receiver 3, and any device having the same function is able to be used in place of this. It is to be noted that the BD player 1 and the AV receiver 3 may be connected by either wire or wireless. The AV receiver 3 may incorporate the function of the BD player 1.

The plurality of audio devices (the wireless speaker 11, the wireless speaker 12, the wireless speaker 13, the wireless speaker 14, and the wireless speaker 15) are respectively arranged in different positions. In this example, the wireless speaker 11 is arranged in the front of a listening position, the wireless speaker 12 is arranged in the right front of the listening position, the wireless speaker 13 is arranged in the right rear of the listening position, the wireless speaker 14 is arranged in the left rear of the listening position, and the wireless speaker 15 is arranged in the left front of the listening position. The AV receiver 3 constructs a wireless LAN through a wireless router to be connected or a wireless communication function of the own device. Through the wireless network, the plurality of wireless speakers including the wireless speaker 11, the wireless speaker 12, the wireless speaker 13, the wireless speaker 14, and the wireless speaker 15 are connected to the AV receiver 3. It is to be noted that the number of audio devices or the arrangement of the audio devices are able to be properly changed according to the use condition of a user.

The AV receiver 3 corresponds to the content output device of the present invention. The AV receiver 3 outputs content including a plurality of channels. In the present preferred embodiment, examples of the content include multi-channel audio data. The content output device of the present invention is able to be realized, for example, by a speaker provided with a CPU or a DSP or an information processing apparatus such as a personal computer, other than the AV receiver 3. The plurality of audio devices of the present invention may be receivers.

To each of the plurality of audio devices (the wireless speaker 11, the wireless speaker 12, the wireless speaker 13, the wireless speaker 14, and the wireless speaker 15), an IC tag 51, an IC tag 52, an IC tag 53, an IC tag 54, and an IC tag 55 that each correspond to the medium of the present invention are attached. The IC tag 51, the IC tag 52, the IC tag 53, the IC tag 54, and the IC tag 55 are attachable and detachable to and from the plurality of audio devices (the wireless speaker 11, the wireless speaker 12, the wireless speaker 13, the wireless speaker 14, and the wireless speaker 15), and each store channel information.

The channel information stored in each IC tag is a center (C) channel, a front right (FR) channel, a surround right (SR) channel, a surround left (SL) channel, and a front left (FL) channel, in this preferred embodiment. For example, the IC tag 51 stores channel information of the center (C). Similarly, the IC tag 52 stores channel information of the front right (FR) channel, the IC tag 53 stores channel information of the surround right (SR) channel, the IC tag 54 stores channel information of the surround left (SL) channel, and the IC tag 55 stores channel information of the front left (FL) channel.

The channel information stored in each IC tag may be visible in appearance. For example, an IC tag may display stored channel information as a character on the surface of the IC tag. As a result, in a case in which the IC tag is attached to a different audio device, for example, a user can easily notice a mistake, detach the IC tag, and attach the IC tag to a correct audio device.

As the medium of the present invention, other than an IC tag, any medium is able to be employed as long as the medium is attachable and detachable to and from the plurality of audio devices (the wireless speaker 11, the wireless speaker 12, the wireless speaker 13, the wireless speaker 14, and the wireless speaker 15) and is able to store channel information. In addition, a state of being attachable and detachable indicates a state in which a speaker and an IC tag are in proximity to each other and a state in which a speaker and an IC tag are not in proximity to each other. Moreover, the state of being attached may be the state in which a speaker and an IC tag are in proximity to each other, may be a case in which an IC tag is directly attached to a speaker by an adhesive tape or the like, or may be a case in which a folder capable of supporting an IC tag is formed on a speaker and an IC tag is inserted into the folder.

Subsequently, a detailed description will be made of an audio device, and, since the plurality of audio devices (the wireless speaker 11, the wireless speaker 12, the wireless speaker 13, the wireless speaker 14, and the wireless speaker 15) have the same configuration, the following will mainly describe the wireless speaker 11.

As illustrated in FIG. 2, the wireless speaker 11 is provided with a CPU 21, a proximity communication portion 22, a communication portion 24, a RAM 25, a DSP 26, a ROM 27, and a speaker 28. The CPU 21 is provided with an obtaining portion 23. The communication portion 24 is provided with a transmitting portion 241 and a receiving portion 242.

The CPU 21 performs the following various operations by reading out a program stored in the ROM 27 being a storage medium to the RAM 25.

The proximity communication portion 22 corresponds to the reading portion of the present invention, and, for example, a near field wireless communication technique such as an RFID and an IR is adopted. When electric power is supplied from a not-shown power source to the wireless speaker 11, the proximity communication portion 22 reads out the channel information stored in the IC tag 51 from the IC tag 51. For example, the proximity communication portion 22 reads out the channel information of the center (C) stored in the IC tag 51.

The CPU 21 obtains the individual identification information of the wireless speaker 11. The obtaining portion 23 of the CPU 21 has the function of obtaining the individual identification information. The individual identification information is unique information related to the wireless speaker 11 itself. The individual identification information may be, for example, a MAC address or a product serial number of the wireless speaker 11 itself.

The communication portion 24 inputs and outputs a wireless signal in accordance with standards such as Wi-Fi (registered trademark) standards and Bluetooth (registered trademark) standard, for example. This communication portion 24 enables the wireless speaker 11 to communicate with the AV receiver 3.

The transmitting portion 241 receives the channel information of the center (C) stored in the IC tag 51 and the individual identification information of the wireless speaker 11, and transmits the information to the AV receiver 3. It is to be noted that the RAM 25, after storing channel information once, is able to read the channel information. As a result, in a case in which a problem occurs in the IC tag 51 during use, the channel information stored in the RAM 25 is able to be used until valid channel information is able to be obtained.

The receiving portion 242 to be described below in detail receives at least one channel out of content of a multi-channel from the AV receiver 3. The speaker 28 outputs sound related to the content received from the AV receiver 3. Hereinafter, a detailed description will be made of the AV receiver 3.

As illustrated in FIG. 3, the AV receiver 3 is provided with a CPU 31, a content input portion 32, a RAM 33, a communication portion 34, and a ROM 35. The CPU 31 is provided with an assigning portion 36. The communication portion 34 is provided with a transmitting portion 341 and a receiving portion 342.

The content input portion 32 inputs content from the BD player 1.

The receiving portion 342 receives channel information and individual identification information that have been transmitted from the plurality of audio devices (the wireless speaker 11, the wireless speaker 12, the wireless speaker 13, the wireless speaker 14, and the wireless speaker 15).

The CPU 31 reads out a program stored in the ROM 35 to the RAM 33, and performs the following various operations.

FIG. 4 is a table illustrating an example of channel information of each IC tag stored in a memory of the AV receiver 3 and a channel of content to be assigned to each audio device (the wireless speaker 11, wireless speaker 12, wireless speaker 13, wireless speaker 14, and wireless speaker 15). The CPU 31, based on the information received in the receiving portion 342, assigns a channel to each of the plurality of audio device (the wireless speaker 11, the wireless speaker 12, the wireless speaker 13, the wireless speaker 14, and the wireless speaker 15). The assigning portion 36 of the CPU 31 has the function of assigning a channel.

As illustrated in FIG. 4, the wireless speaker 11 has an IP address for receiving a channel from the AV receiver 3. In addition, the wireless speaker 11 has a MAC address being individual identification information unique to the wireless speaker 11. The IP address and the MAC address are previously associated with each other, and are stored in the memory of the AV receiver 3. When the IC tag 51 that has the channel information of the center (C) is attached to the wireless speaker 11, the wireless speaker 11 reads out the channel information from the IC tag 51, and transmits the channel information together with the individual identification information, to the AV receiver 3. The CPU 31 identifies an IP address of the wireless speaker corresponding to the received MAC address. The CPU 31 assigns a channel on the basis of the received channel information, to the identified IP address. In this manner, the CPU 31 assigns a channel suitable for the center (C) to the wireless speaker 11. Similarly, the CPU 31 also assigns a channel on the basis of the information that each wireless speaker has, to other wireless speakers 12 to 15. As a result, a channel is able to be set to the plurality of audio devices (the wireless speaker 11, the wireless speaker 12, the wireless speaker 13, the wireless speaker 14, and the wireless speaker 15). In addition, a user, when assigning a channel, does not need to operate a button or the like for setting of a channel and can set a channel easily. Therefore, even when a plurality of wireless speakers are arranged, a plurality of persons can divide the work of placement, so that the plurality of wireless speakers are able to be placed efficiently even in case of a large-scale hall such as a concert hall.

The transmitting portion 341 transmits a signal of the channel assigned for each of the plurality of audio devices (the wireless speaker 11, the wireless speaker 12, the wireless speaker 13, the wireless speaker 14, and the wireless speaker 15), to each of the wireless speakers. Thus, the channel according to each wireless speaker is distributed, and each wireless speaker reproduces sound related to the content corresponding to the distributed channel. As illustrated in FIG. 4, for example, a channel suitable for the center (C) is distributed in the wireless speaker 11 to which the IC tag 51 that has the channel information of the center (C) is attached. The speaker 28 with which the wireless speaker 11 is provided reproduces sound related to content suitable for the center (C). Therefore, even in a case in which the audio system 10 has a plurality of audio devices and a plurality of channels, the channel included in content is able to be easily assigned to a specific audio device.

Figure 5A:
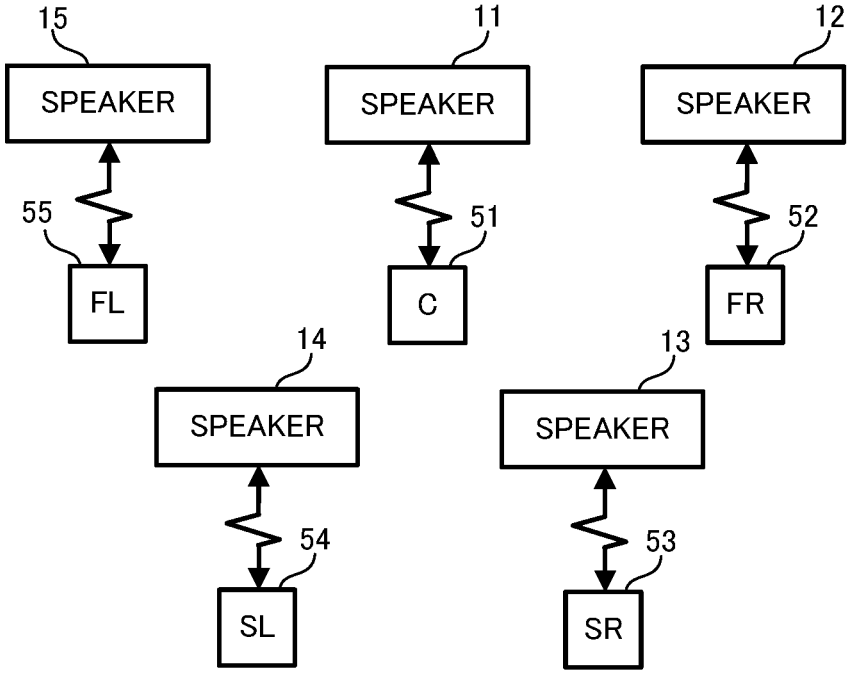
FIG. 5A and FIG. 5B are diagrams illustrating an example of the assignment of a channel of content in the audio system.
Figure 5B:
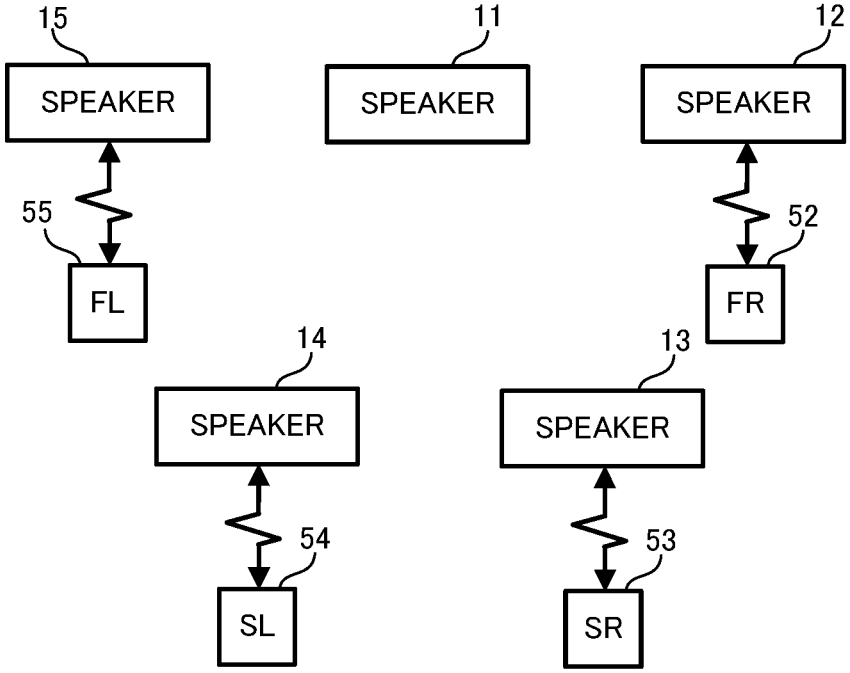

FIG. 5A and FIG. 5B are diagrams illustrating an example of the assignment of a channel of content in the audio system 10.

In a case in which the IC tag 51 is attached to the wireless speaker 11, the proximity communication portion 22 outputs obtained information that indicates a state in which the proximity communication portion 22 obtains channel information. On the other hand, in a case in which the IC tag 51 is not attached to the wireless speaker 11 or in a case in which the IC tag 51 is present and the wireless speaker 11 is out of order or is not present, the proximity communication portion 22 may output non-obtained information that indicates a state in which channel information is not obtained. Alternatively, in a case in which the IC tag 51 is attached to the wireless speaker 11 and the IC tag 51 does not have channel information, the proximity communication portion 22 may output non-obtained information. The proximity communication portion 22, for example, may output non-obtained information by determining a case in which the proximity communication portion 22 does not obtain obtained information for a specified period of time after a power source is supplied to the wireless speaker 11 or for a specified period of time after the individual identification information of the wireless speaker 11 is input to the transmitting portion 241, as a non-obtained state. The CPU 21 obtains the obtained information or the non-obtained information from the proximity communication portion 22, and transmits the information to the communication portion 24.

The transmitting portion 241 of the communication portion transmits the obtained information or the non-obtained information to the AV receiver 3. The receiving portion 342 receives channel information and individual identification information that have been transmitted from the plurality of audio devices (the wireless speaker 11, the wireless speaker 12, the wireless speaker 13, the wireless speaker 14, and the wireless speaker 15). The receiving portion 342 transmits the obtained information or the non-obtained information to the assigning portion 36.

The assigning portion 36, by obtaining the obtained information or the non-obtained information, may determine whether or not an audio device should be included in a group composed of the plurality of audio devices (the wireless speaker 11, the wireless speaker 12, the wireless speaker 13, the wireless speaker 14, and the wireless speaker 15 in the present preferred embodiment, for example) in the audio system 10. In other words, the assigning portion 36, depending on the communication state from the IC tag 51 to the IC tag 55 to the wireless speaker 11, the wireless speaker 12, the wireless speaker 13, the wireless speaker 14, and the wireless speaker 15, determines any of the wireless speaker 11, the wireless speaker 12, the wireless speaker 13, the wireless speaker 14, and the wireless speaker 15 should be included in a group that distributes the same content.

As illustrated in FIG. 5A, the IC tag 51 to the IC tag 55 are attached to all of the wireless speaker 11, the wireless speaker 12, the wireless speaker 13, the wireless speaker 14, and the wireless speaker 15, respectively. In such a case, each of the wireless speakers transmits the obtained information to the AV receiver 3. Therefore, the assigning portion 36 determines that all of the wireless speaker 11, the wireless speaker 12, the wireless speakers 13, the wireless speaker 14, and the wireless speaker 15 are included in the same group. On the other hand, as illustrated in FIG. 5B, in a case in which the IC tag 51 is not attached to the wireless speaker 11, the wireless speaker 11 transmits the non-obtained information to the AV receiver 3.

In a case in which the receiving portion 342 of the AV receiver 3 receives the non-obtained information, the AV receiver 3 may issue a warning to a user. For example, as illustrated in FIG. 5B, in a case in which the wireless speaker 11 is not able to obtain channel information from the IC tag 51, the AV receiver 3 gives a user a warning that channel information is not assigned to the wireless speaker 11. The user, by attaching the IC tag 51 to the wireless speaker 11, can supplement the group that distributes the same content with the wireless speaker 11. As a result, the user can rearrange the audio system 10 to create an appropriate environment for reproducing the same content.

In addition, when the user removes the IC tag from the plurality of audio devices included in the group that distributes the same content, the user can improve the environment in which content is reproduced, according to the preference of the user. For example, when the user removes the IC tag 51 from the wireless speaker 11, the AV receiver 3 issues a warning to the user. The user performs an instruction for releasing the warning. The audio system 10 excludes the wireless speaker 11 from the group that distributes the same content. Accordingly, the front right (FR) channel, the surround right (SR) channel, the surround left (SL) channel, and the front left (FL) channel are distributed to the wireless speaker 12, the wireless speaker 13, the wireless speaker 14, and the wireless speaker 15, respectively. In other words, the audio system 10 reproduces content while the channel of the center (C) is excluded. The user can move the wireless speaker 11 to another room, and reproduce sound related to another piece of content, using the wireless speaker 11.

Figure 6A:
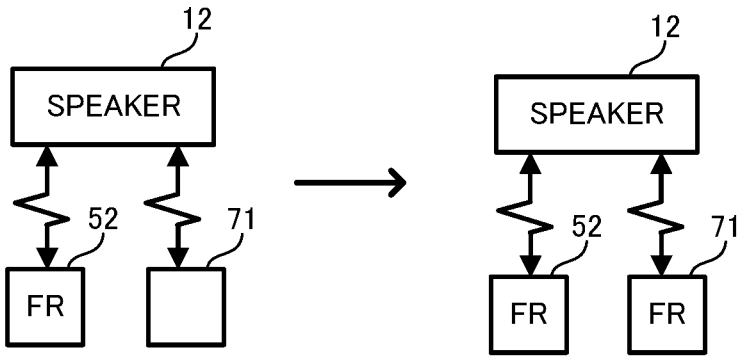
FIG. 6A and FIG. 6B are diagrams illustrating a copy of the channel information in an IC tag.
Figure 6B:
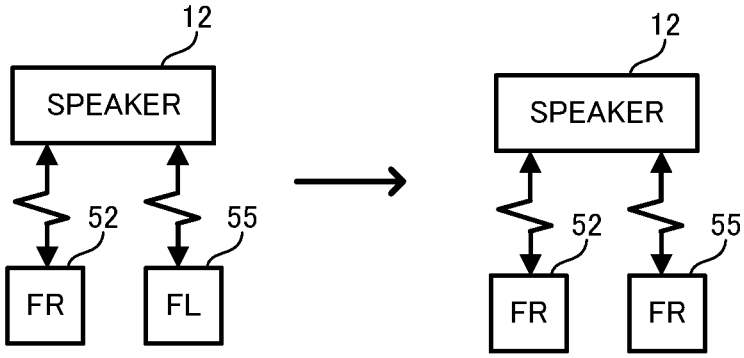

FIG. 6A and FIG. 6B are diagrams illustrating a copy of the channel information in an IC tag. As illustrated in FIG. 6A, the IC tag 52 is attached to the wireless speaker 12. The user, by attaching an IC tag 71 that has no channel information to the wireless speaker 12, can copy the channel information of the IC tag. More specifically, the user gives an instruction for copying channel information to the wireless speaker 12 by using a device such as a not-shown portable terminal capable of wireless communication. When the portable terminal gives a copy instruction to the wireless speaker 12, the wireless speaker 12 reads out from the IC tag 52 the information stored in the IC tag 52. The wireless speaker 12 writes the information read from the IC tag 52 into the IC tag 71. In addition, when obtained information and non-obtained information are obtained, the wireless speaker 12 may automatically copy the information stored in the IC tag 52. More specifically, the CPU 21 obtains obtained information and non-obtained information. The CPU 21 reads out the information stored in the IC tag 52 from which the obtained information has been obtained. The CPU 21 writes the information read from the IC tag 52 into the IC tag 71 from which the non-obtained information has been obtained. As a result, the IC tag 71 into which the information has been newly written is able to be used similarly to the IC tag 52. It is to be noted that, in this preferred embodiment, the IC tag 71 corresponds to a second medium of the present invention.

In addition, FIG. 6B illustrates a case in which the IC tag 52 is attached to the wireless speaker 12 and a case in which the IC tag 55 that has already stored channel information is attached here as the second medium. The IC tag 52 stores the channel information of the front right (FR), and the IC tag 55 stores the channel information of the front left (FL), respectively. The user, by attaching the IC tag 55 that has the channel information of the front left (FL) to the wireless speaker 12, can copy the channel information that the IC tag 52 has. More specifically, the user gives an instruction for copying channel information to the wireless speaker 12 by using a device such as a not-shown portable terminal capable of wireless communication. When the portable terminal gives a copy instruction to the wireless speaker 12, the wireless speaker 12 reads out from the IC tag 52 the information stored in the IC tag 52. The wireless speaker 12 overwrites the information read from the IC tag 52 on the IC tag 55. As a result, even an IC tag that stores unnecessary channel information is able to be used by overwriting channel information.

It is to be noted that, while, in the present preferred embodiment, each IC tag stores, in advance or by copying, the channel information corresponding to the placement of the audio devices to which each IC tag is attached, the user can later rewrite the channel information to different channel information. The memory of the AV receiver 3 stores the channel information of each IC tag and the channel information of content to be assigned to each audio device (the wireless speaker 11, wireless speaker 12, wireless speaker 13, wireless speaker 14, and wireless speaker 15). For example, as illustrated in FIG. 4, the IC tag 51 is attached and the channel of the center (C) is assigned, to the wireless speaker 11. Similarly, each IC tag is attached and a channel is assigned, to the wireless speaker 12 to the wireless speaker 15. The user inputs assignment information of a new channel to the receiving portion 342. For example, the user respectively inputs the assignment information of the front right (FR) channel, the surround right (SR) channel, the surround left (SL) channel, the front left (FL) channel, and the center (C) channel to the wireless speaker 11, the wireless speaker 12, the wireless speaker 13, the wireless speaker 14, and the wireless speaker 15. The assigning portion 36 of the CPU 31 reassigns a channel to each audio device based on the assignment information of a new channel. Accordingly, the memory of the AV receiver 3 stores reassignment information. As a result, the present use configuration is able to be changed to a use configuration in which the wireless speaker 15 is in front. In a case in which a change occurs in a use state, the user can cope by rewriting the information stored in the memory of the AV receiver 3.

Figure 7A:
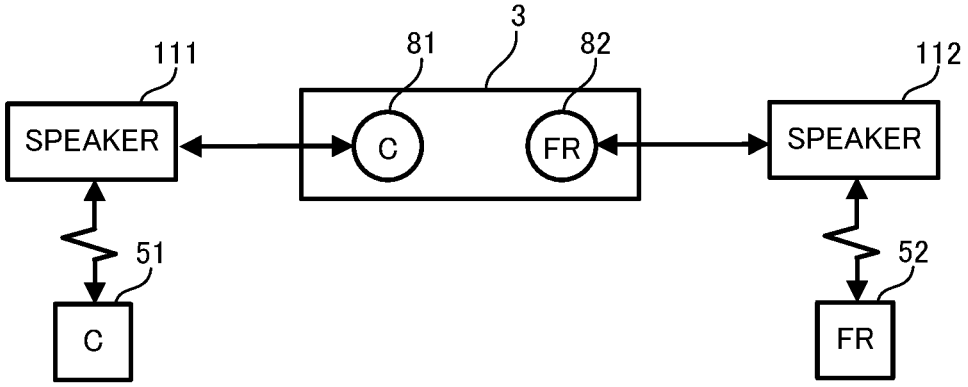
FIG. 7A, FIG. 7B, and FIG. 7C are diagrams illustrating a case in which an AV receiver, a speaker and a speaker are connected by wire.
Figure 7B:
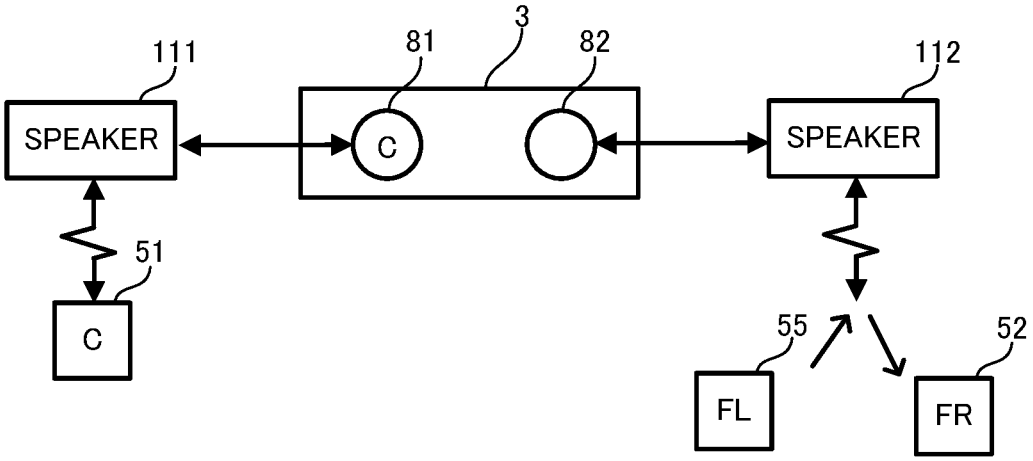
Figure 7C:
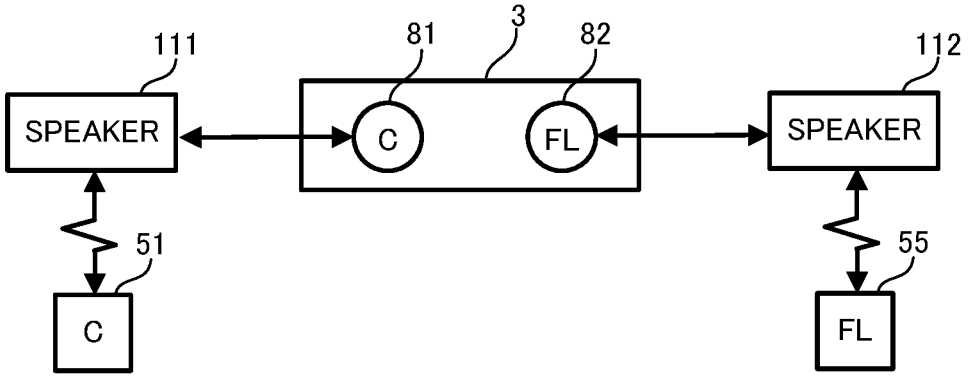

It is to be noted that, in the present preferred embodiment, the AV receiver 3, while being connected to the plurality of wireless speakers including the wireless speaker 11, the wireless speaker 12, the wireless speaker 13, the wireless speaker 14, and the wireless speaker 15 through the wireless network, may be connected by wire. FIG. 7A, FIG. 7B, and FIG. 7C are diagrams illustrating a case in which the AV receiver 3, a speaker 111 and a speaker 112 are connected by wire. The speaker 111 and the speaker 112 are wired speakers, and are connected to the AV receiver 3 by a cable or the like. The IC tag 51 is attached to the speaker 111, and the IC tag 52 is attached to the speaker 112. Ordinarily, in a case of being connected by wire, the channel of the output terminal of the AV receiver 3 is fixed, but the present embodiment enables the channel of the output terminal to be changed later.

For example, as illustrated in FIG. 7A, in a case in which the speaker 111 and the speaker 112 are connected to the AV receiver 3, the output terminals 81 and 82 of the AV receiver 3 respectively correspond to the connected speaker 111 and speaker 112. The output terminal 81 corresponds to the channel of the center (C) that the speaker 111 has read out from the IC tag 51. The output terminal 82 corresponds to the channel of the front right (FR) that the speaker 112 has read out from the IC tag 52.

In the present preferred embodiment, as illustrated in FIG. 7B, in a case in which the IC tag 52 is removed from the speaker 112, the output terminal 82 does not correspond to any channel. As illustrated in FIG. 7C, the IC tag 55 that has stored the channel information of the left front (FL) is attached to the speaker 112, in place of the IC tag 52. The speaker 112 reads out the channel information from the IC tag 55. The AV receiver 3 causes the output terminal 82 to correspond to the channel of the left front (FL) based on the channel information read out from the IC tag 55. In this manner, the output terminal of the AV receiver 3 is able to be freely assigned.

It is to be noted that, while, in the present preferred embodiment, an IC tag to be attached to an audio device is used, instead of such an IC tag, a medium may be embedded in a not-shown power cable that supplies electric power from a power source and may be caused to store information. For example, a power cable for a predetermined channel is prepared in advance. The medium embedded in the power cable stores the channel information of the center (C) and the like. Transmission of information between the medium and the speaker is realized by either wire or wireless. In the case of a wired connection, a communication line is wired in the power cable. The power cable is connected to a speaker, so that the speaker is able to read out the channel information stored in the medium, through the communication line. In a case in which information is transmitted by wire, physically direct connection enables influence due to other electromagnetic waves or the like to be reduced. In a case of a wireless connection, the speaker is connected to the power cable and thus the speaker and the medium come in proximity to each other. The proximity communication portion of the speaker is able to read out the channel information stored in the medium. In any case, when the user connects the power cable to the speaker, the speaker is able to read out the channel information, so that the time and effort to attach an IC tag is able to be saved. In addition, the user can change the channel easily by changing the power cable.

Figure 8:
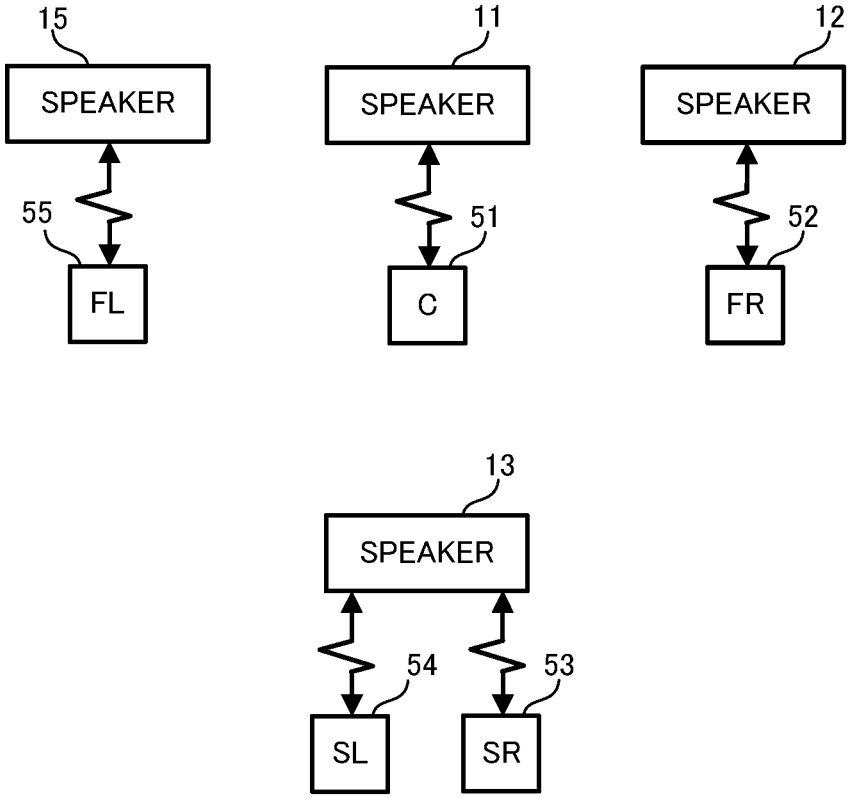
FIG. 8 is a diagram illustrating a case in which a plurality of IC tags are attached to a speaker.

FIG. 8 is a diagram illustrating a case in which a plurality of IC tags are attached to a speaker. While, in the above preferred embodiment, one IC tag is attached to each speaker, a plurality of IC tags may be attached to a speaker. As illustrated in FIG. 8, the IC tag 53 that has stored the channel information of the surround right (SR) and the IC tag 54 that has stored the channel information of the surround left (SL) are attached to the wireless speaker 13. The AV receiver 3 distributes a channel corresponding to the surround right (SR) and the surround left (SL) to the wireless speaker 13. As a result, the wireless speaker 13 is able to output sound related to the channels of the surround right (SR) and the surround left (SL) in the content.

Figure 9:
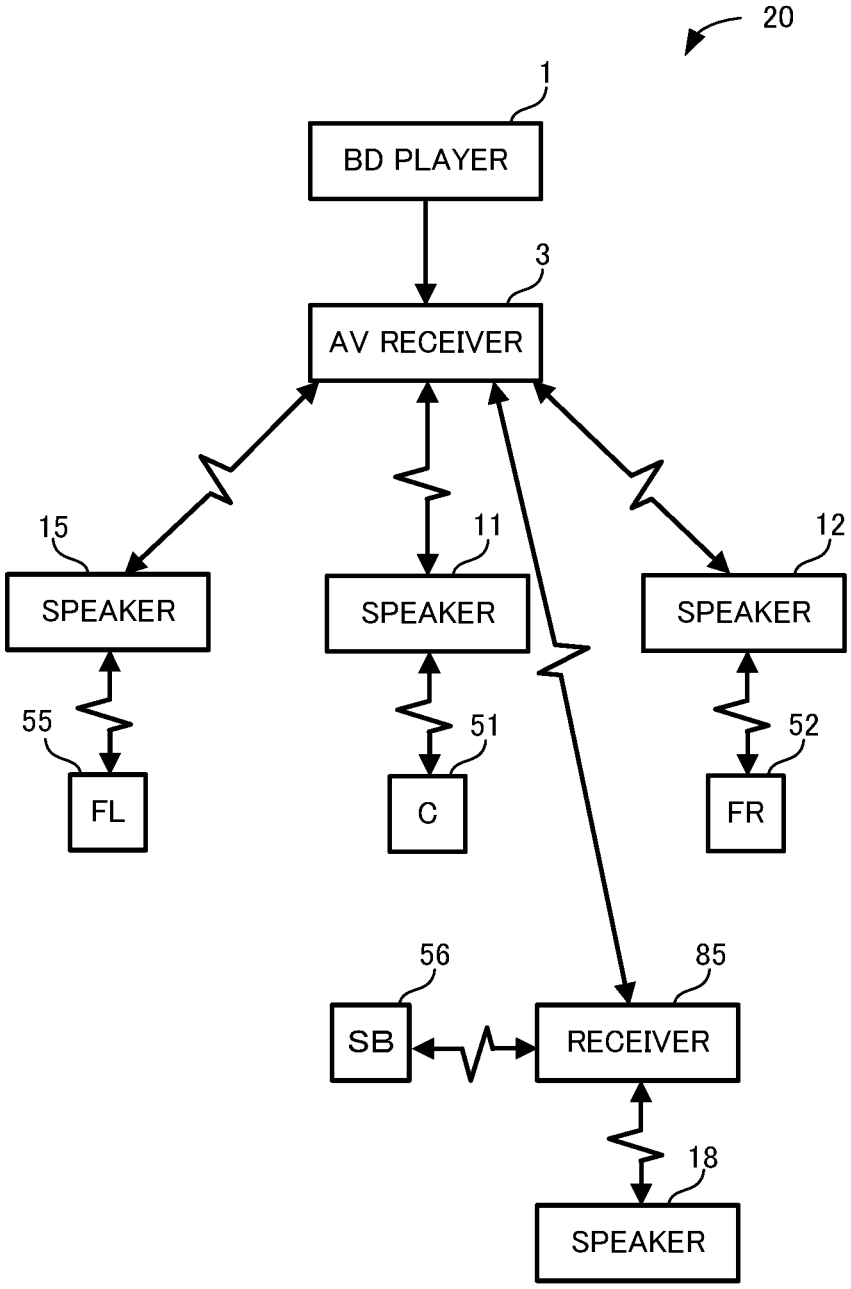
FIG. 9 is a conceptual diagram illustrating a configuration of an audio system according to another preferred embodiment.

FIG. 9 is a conceptual diagram illustrating a configuration of an audio system 20 according to another preferred embodiment. As illustrated in FIG. 9, the audio system 20 is provided with a receiver 85 as an audio device. The receiver 85 is connected to a speaker 18. An IC tag 56 that has stored channel information of surround back (SB) is attached to the receiver 85. The receiver 85 reads out the channel information of surround back (SB) from the IC tag 56.

When a user connects the receiver 85 to another AV receiver 3 by wireless, the receiver 85 and the AV receiver 3 are able to communicate mutually. As a result, the AV receiver 3 is able to distribute the channel included in the same content to the receiver 85. In other words, the AV receiver 3 is able to assign a surround back (SB) channel to the receiver 85.

It is to be noted that the receiver 85 is also able to be used alone. When using the receiver alone, for example, a user removes the IC tag 56 from the receiver 85. The receiver 85, since distribution of the content from the AV receiver 3 is stopped, is able to reproduce content different from the content of the AV receiver 3.

Figure 10:
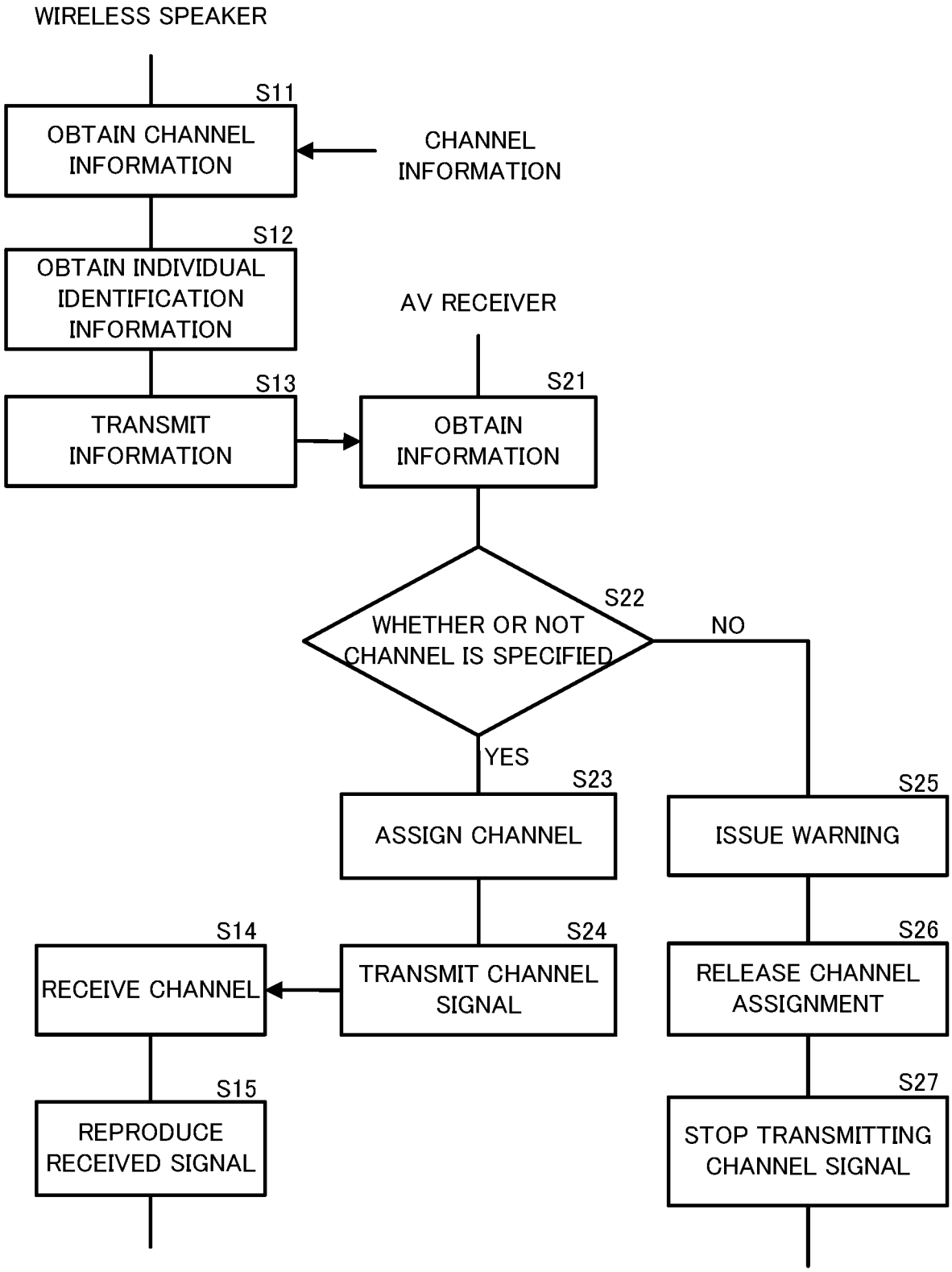
FIG. 10 is a flow chart showing an operation of the audio system.

FIG. 10 is a flow chart showing an operation of the audio system 10. The operation of the audio system 10 realizes a channel distribution method of the present invention.

In the audio system 10, a user selects content to desire to reproduce in advance. In other words, the user gives an instruction for selection of content to the BD player 1. The BD player 1 outputs the content that the user has selected, to the AV receiver 3.

As illustrated in FIG. 10, the reading portion of each audio device obtains the channel information stored in the IC tag 51 to the IC tag 55, from the IC tag 51 to the IC tag 55 (S11). Obtaining the channel information serves as a trigger and starts the operation of the audio system 10. The obtaining portion 23 obtains individual identification information of each of the wireless speaker 11 to the wireless speaker 15 (S12). The transmitting portion 241 and the like of the wireless speaker 11 to the wireless speaker 15 transmits the channel information read from the IC tag 51 to the IC tag 55, and the obtained individual identification information to the AV receiver 3 (S13).

The AV receiver 3 receives the information that the wireless speaker 11 to the wireless speaker 15 transmitted (S21). The assigning portion 36 of the AV receiver 3 determines whether or not the channel information is obtained. In other words, the assigning portion 36 determines whether or not a channel is specified by receiving either of obtained information that indicates a state in which the channel information is obtained or non-obtained information that indicates a state in which the channel information is not obtained (S22).

In a case in which a channel is specified (S22: YES), the assigning portion 36 assigns the channel to the wireless speaker 11 to the wireless speaker 15 based on the channel information and the individual identification information that have been received (S23). The AV receiver 3 transmits an assigned channel signal to the wireless speaker 11 to the wireless speaker 15 (S24).

The wireless speaker 11 to the wireless speaker 15 each receive the signal of the channel that the assigning portion 36 assigned (S14). Therefore, even in a case in which the audio system 10 has the plurality of audio devices including the wireless speaker 11 to the wireless speaker 15 and the plurality of channels, the channel included in content is able to be easily assigned to a specific audio device. The wireless speaker 11 to the wireless speaker 15 reproduce sound related to the content corresponding to the signal of the channel that each speaker has received (S15), and then the operation of the audio system 10 ends.

In a case in which a channel is not specified (S22: NO), the AV receiver 3 issues a warning to a user (S25). The CPU 31 of the AV receiver 3 releases the assigning portion 36 from assignment of a channel (S26). The AV receiver 3 stops the transmission of the channel signal assigned to the wireless speaker 11 to the wireless speaker 15 (S27). As a result, the operation of the audio system 10 ends.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An audio device, comprising:

at least one processing circuit configured to implement stored instructions and execute a plurality of tasks, wherein the plurality of tasks include:

a reading task that, from a medium that stores channel information indicating a channel of multi-channel audio data, reads the channel information by near field wireless communication;

an obtaining task that obtains individual identification information of an own device;

a transmitting task that transmits the channel information read from the medium and the individual identification information to a content output device that outputs content including a plurality of channels; and a receiving task that receives the content, wherein the content to be received in the receiving task is an assigned channel of the plurality of channels that is assigned to the audio device, and the assigned channel corresponds to the channel information read in the reading task;

wherein the transmitting task transmits, to the content output device, information that indicates whether the channel information is obtained or not.

2. The audio device according to claim 1, further comprising:

a speaker that outputs sound related to the content, wherein the receiving task receives the content through wireless communication.

3. The audio device according to claim 1, wherein the channel information stored in the medium is copied to a second medium.

4. The audio device according to claim 1, wherein the near field wireless communication is RFID.

5. The audio device according to claim 1, wherein the medium is an IC tag.

6. The audio device according to claim 1, wherein the information that indicates whether the channel information is obtained or not is provided by a proximity communication device attached to the audio device.

7. An audio system, comprising:

the audio device according to claim 1; and the content output device, wherein the content output device includes an assigning task that assigns a channel to the audio device based on the channel information and the individual identification information.

8. The audio system according to claim 7, further comprising:

a speaker that outputs sound related to the content, wherein the receiving task receives the content through wireless communication.

9. The audio system according to claim 7, wherein the channel information stored in the medium is copied to a second medium.

10. The audio system according to claim 7, wherein:

the medium is attachable and detachable to and from the audio device;

the assigning task determines whether or not the system is included in a group that distributes a same content based on a communication state from the medium to the audio device.

11. The audio system according to claim 7, wherein the assigning task simultaneously assigns the plurality of channels to one audio device.

12. The audio system according to claim 7, wherein the near field wireless communication is RFID.

13. The audio system according to claim 7, wherein the medium is an IC tag.

14. A channel distribution method, comprising:

reading, from a non-transitory medium that stores channel information indicating a channel of multi-channel audio data, the channel information by near field wireless communication;

obtaining individual identification information of an own device;

transmitting the channel information read from the non-transitory medium and the individual identification information to a content output device that outputs content including a plurality of channels;

assigning the channel of the multi-channel audio data to an audio device based on the channel information and the individual identification information;

receiving the content, wherein the content to be received is an assigned channel of the plurality of channels that is assigned to the audio device, and the assigned channel corresponds to the channel information read in the reading task; and transmitting, to the content output device, information that indicates whether the channel information is obtained or not.

15. The channel distribution method according to claim 14, comprising:

receiving the content through wireless communication; and outputting sound related to the content from a speaker.

16. The channel distribution method according to claim 14, further comprising copying the channel information stored in the non-transitory medium to a second non-transitory medium.

17. The channel distribution method according to claim 14, wherein the near field wireless communication is RFID.

18. The channel distribution method according to claim 14, wherein the non-transitory medium is an IC tag.

19. The channel distribution method according to claim 14, wherein the information that indicates whether the channel information is obtained or not is provided by a proximity communication device attached to the audio device.

* * * * *